US007367655B2

(12) United States Patent
Scardovi et al.

(10) Patent No.: US 7,367,655 B2
(45) Date of Patent: May 6, 2008

(54) INTEGRATED PRINTHEAD WITH ENCODING CIRCUIT

(75) Inventors: Alessandra Scardovi, Ivrea (IT); Renato Conta, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 286 days.

(21) Appl. No.: 10/538,749

(22) PCT Filed: Dec. 19, 2003

(86) PCT No.: PCT/IT03/00842

§ 371 (c)(1),
(2), (4) Date: Jun. 14, 2005

(87) PCT Pub. No.: WO2004/056571

PCT Pub. Date: Jul. 8, 2004

(65) Prior Publication Data

US 2006/0244771 A1 Nov. 2, 2006

(30) Foreign Application Priority Data

Dec. 23, 2002 (IT) ..... TO2002A1113

(51) Int. Cl.
*B41J 2/05* (2006.01)

(52) U.S. Cl. ..... 347/57; 347/58

(58) Field of Classification Search ..... 347/5, 347/9, 14, 19, 56–59
See application file for complete search history.

(56) References Cited

U.S. PATENT DOCUMENTS

| | | | | |
|---|---|---|---|---|
| 5,363,134 A | | 11/1994 | Badyal et al. | 347/59 |
| 5,506,611 A | * | 4/1996 | Ujita et al. | 347/19 |
| 5,635,968 A | * | 6/1997 | Bhaskar et al. | 347/59 |

FOREIGN PATENT DOCUMENTS

| | | |
|---|---|---|
| EP | 0 916 503 A | 5/1999 |
| WO | 0 274 435 | 7/1988 |
| WO | WO 01/03932 A | 1/2001 |

* cited by examiner

*Primary Examiner*—Juanita D. Stephens
(74) *Attorney, Agent, or Firm*—Venable LLP; Robert Kinberg; Steven J. Schwarz

(57) ABSTRACT

Ink jet printhead comprising a driving and encoding circuit (20) having a grid-like structure, including a plurality of inputs (24), a plurality of selecting elements (12), a plurality of actuating elements (IC) and at least one identifying element (21) of said printhead. Each identifying element (21) is associated with a corresponding selecting element (12) and corresponds to nodes arranged along a row or column of said grid-like structure, and is scanned, together with said actuating elements (11), during a preliminary checking step.

9 Claims, 5 Drawing Sheets

INTEGRATED PRINTHEAD WITH ENCODING CIRCUIT

This application is a National Phase application of co-pending PCT/IT2003/000842, filed Dec. 19, 2003, which was published in English under PCT Article 21(2) on Jul. 8, 2004 and claims the benefit of Italian Application TO 2002 A 001113 filed Dec. 23, 2002. These applications are incorporated herein in their entirety.

TECHNOLOGICAL AREA OF THE INVENTION

This invention relates to a thermal type ink jet printhead, in which a plurality of actuating elements are activated selectively by an external control circuit, to cause the ejection of ink droplets through nozzles placed in correspondence with the actuating elements themselves.

In particular, this invention relates to an integrated printhead, comprising in the integrated circuit elements identifying the head itself, in accordance with the description provided in the main claim.

TECHNICAL BACKGROUND

The constitution and general mode of operation of a thermal type ink jet printhead, and in particular of the type known as "top shooter", i.e. that emits the ink droplets in a direction perpendicular to the actuating assembly, are already widely known in the art, and, therefore will not be described in detail here, while only some characteristics of relevance for the purposes of the understanding of this invention will be described more particularly.

With reference to FIG. 1, an integrated printhead (head) 10, according to the known art, is made of an integrated circuit, for instance NMOS or bipolar type and comprises a plurality of nozzles 31, positioned on the head 10 according to a predefined order and suitable for ejecting ink on a medium, generally of paper, and a plurality of inputs or contacts 23; provided for connecting the head 10 to an external control circuit, suitable for commanding the selective actuation of the various nozzles 31.

The known head 10 (FIG. 2) is made of a grid-like driving circuit (M×N) comprising a plurality M of actuating assemblies 14. Each actuating assembly 14 in turn comprises a plurality N of selecting-elements or transistors 12 and an equivalent number of actuating elements or resistors 11 which are provided for causing, in a known way, ejection of the ink from the nozzles 31.

Also described by the U.S. Pat. No. 5,363,134 is an integrated printhead that comprises an encoding circuit, in which, by burning programmable fuses, information can be stored about the general characteristics of the head, such as for instance: colour head, its resolution, number of nozzles.

The encoding circuit is integrated on the same substrate as the selecting and activating circuit of the resistors and is composed of a row of programmable fuses, each of which is connected in series with a transistor.

Besides, each couple comprising a fuse and a transistor of the encoding circuit, is permanently connected to an Address Line and has the advantage of permitting reading of the coding stored without increasing the number of head connections.

It is in fact advantageous to have the possibility of identifying, through the printer's control circuit, a set of head characteristics, stored during the production of the head, that can cause a non-uniformity of operation between the various nozzles, considerably worsening the print quality.

Some of the characteristics that may be stored are, for instance, misalignments or differences of shape, diameter or center distance between the nozzles.

In possession of this information, the control circuit can compensate, by varying the energy supplied to the resistors, any differences in volume of the ink droplets or of speeds which are caused by these non-uniformities.

This solution has the disadvantage, however, of adding an encoding circuit, formed by N couples of fuses and transistors, where N is the number of addresses in the grid, to those already existing on the head, with a relative increase in the surface area of the integrated circuit and greater costs and manufacturing difficulties. In addition, the encoding circuit can contain at most N fuses.

SUMMARY OF THE INVENTION

The object of this invention is to produce an encoding of the head by using free positions of the grid-like circuit of the head, without having to add a new circuit for the encoding.

A second object is that of using circuits already existing in the driver of the head for reading of the encoding, without having to build a specific circuit, modifying only the software.

A third object is that of producing an encoding of the head using the already present circuits mentioned above, to which only a line of fuses for the encoding is added.

A fourth object is to produce an encoding with a number of fuses greater than the number of addresses.

These objects are attained by the integrated printhead of the invention, according to the characteristic parts of the main claims.

These and other characteristics of this invention will become clear from the following description, provided by way of non-restrictive example, with the aid of the accompanying drawings.

LIST OF FIGURES

DESCRIPTION

First Embodiment

Figure 4:
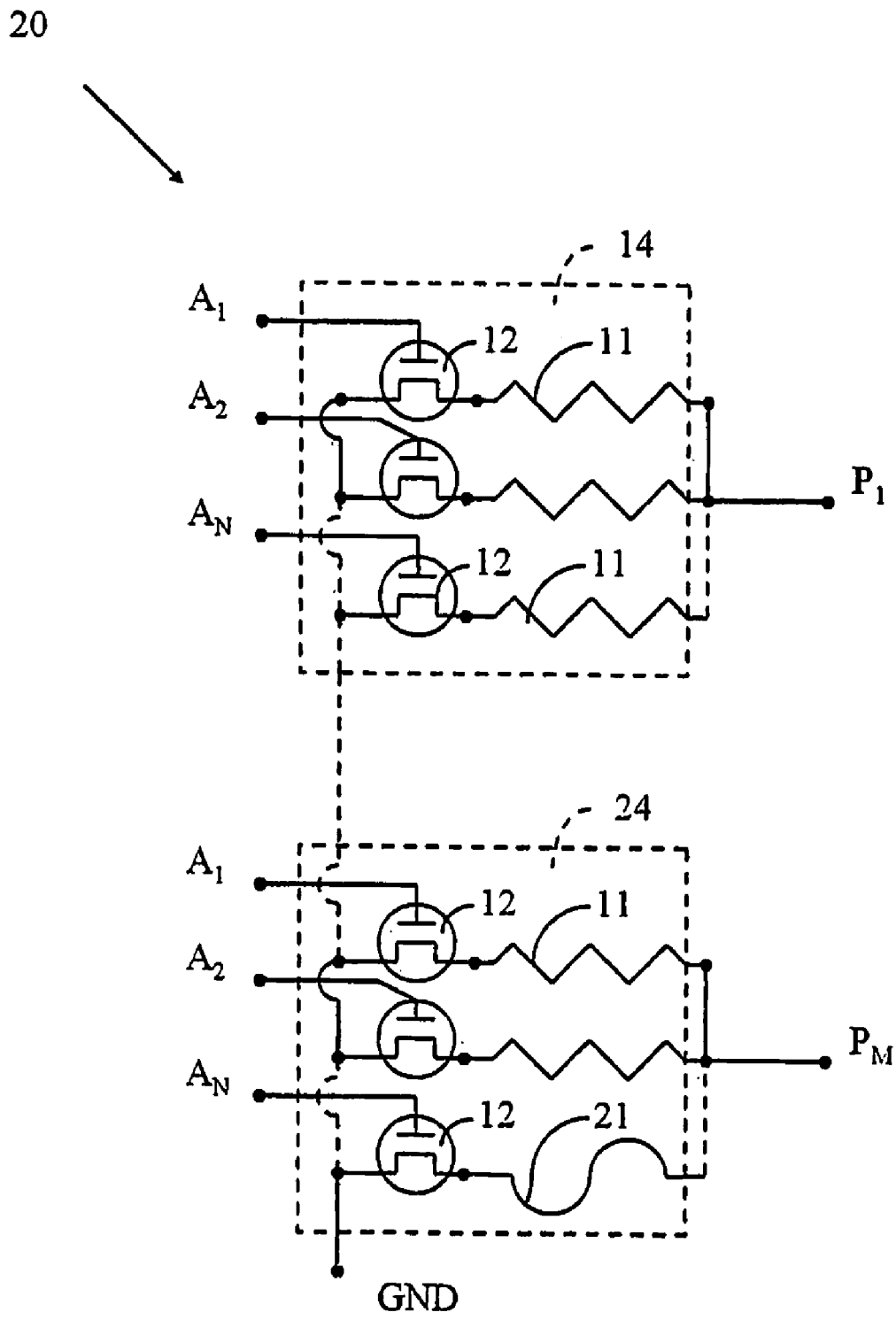
FIG. 4 represents a wiring diagram of the circuit elements of an integrated head according to the invention.

With reference to FIG. 4, an integrated printhead (head), according to the invention, is made up of an integrated circuit, for example NMOS or bipolar type, and comprises a driving and encoding circuit 20, consisting of a plurality of actuating assemblies 14, of known type, and a plurality of actuating assemblies with encoding or encoding assemblies 24.

Each actuating assembly 14, of known type, comprises a plurality of actuating elements or resistors 11, which are provided for causing ejection of the ink droplets from the nozzles 31, and corresponding selecting elements or transistors 12.

In each actuating assembly 14, each transistor 12, of known type, has its drain terminal connected to one of the two terminals of the resistor 11, the source terminal connected in common to the sources of the transistors 12 belonging to the same actuating assembly 14, and the gate terminal connected to the inputs or contacts 23 corresponding to address selection lines (Address Line Select or addresses) $A_{I=1-N}$.

The resistors 11 belonging to an actuating assembly 14 have the second terminal connected in common and to an input or contact 23 corresponding to a primitive feeding line (Primitive Select or primitive) $P_{J=1-M}$.

Each encoding assembly 24 comprises, in addition to the actuating elements, (resistors) 11 of known type, a plurality of identifying elements (resistors or fuses) 21, placed in correspondence with the nozzles of the grid not used for printing, and also comprises a plurality of selecting elements (transistors) 12, in correspondence with the resistors or fuses 21 and the resistors 11.

The identifying elements 21 are therefore in correspondence with empty is positions of the grid (M×N).

In each encoding assembly 24, each transistor 12, of known type, has the drain terminal that can be connected to one of the two terminals of the resistor 11 or of the fuse 21, the source terminal connected in common to the sources of the transistors 12 belonging to the same encoding assembly 24 and the gate terminal connected to the contacts 23 corresponding to address selection lines (Address Line Select or addresses) $A_{I=1-N}$.

The resistors 11 and the fuses 21 belonging to an encoding assembly 24 have the second terminal connected in common and to a contact 23 corresponding to a primitive feeding line (Primitive Select or primitive) $P_{J=1-M}$.

In particular, each actuating assembly 14 and each encoding assembly 24 are activated by means of contacts or primitives $P_{J=1+M}$ and each transistor 12 is selected by means of contacts or addresses $A_{I=1+N}$.

The head according to the invention therefore comprises a driving and encoding circuit (20) having a grid-like structure, formed by the actuating 11, identifying 21 and selecting 12 elements, having M rows and N columns in which:

N is the number of Selectable addresses $A_I$, and is equal to the sum of the number of resistors 11 and fuses 21; and M is the number of primitives $P_J$ suitable for activation.

Generally, in the known heads, not all the available positions of the M×N grid are used for printing.

For instance, there are psychosomatic heads in which the nozzles are divided into three color groups, separated by gaps. The nozzles, of each group are used for printing with ink of one of the three basic colors, and the gap is greater than the center distance between two nozzles. The nozzles located in the gaps are not therefore used for printing, and the positions of the M×N grid corresponding to these nozzles are therefore free. In the head according to the invention, the circuitry part which is usually occupied by the resistors 11, placed in correspondence with the unused nozzles, may therefore be used to accommodate the identifying elements or fuses 21, that form the encoding circuit.

The fuses 21 are burnt, for instance at the time of production of the head, to store the desired characteristics.

In this way, a circuit is obtained for encoding of the head, using positions of the grid that would otherwise be unused, without adding any circuits and without using any extra area.

Take for example a color printhead according to the invention, comprising 192 nozzles (31) and having 16 (M) primitives $P_{J=1-M}$ and 13 (N) addresses $A_{I=1+N}$ suitable for use.

This gives 208 (16*13=208) positions available for driving the nozzles, of which only 192 are actually used.

Therefore 16 (208−192=16) positions remain free, and these are used, in accordance with a characteristic element of this invention, to accommodate, instead of resistors 11, the fuses 21 that form the encoding circuit.

Figure 1:
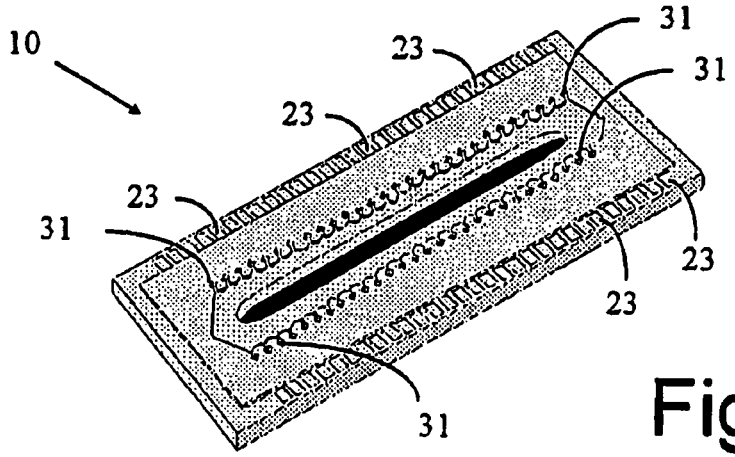
Fig. 1 PRIOR ART
FIG. 1 represents a schematic assembly view of an integrated printhead according to the known art.
Figure 2:
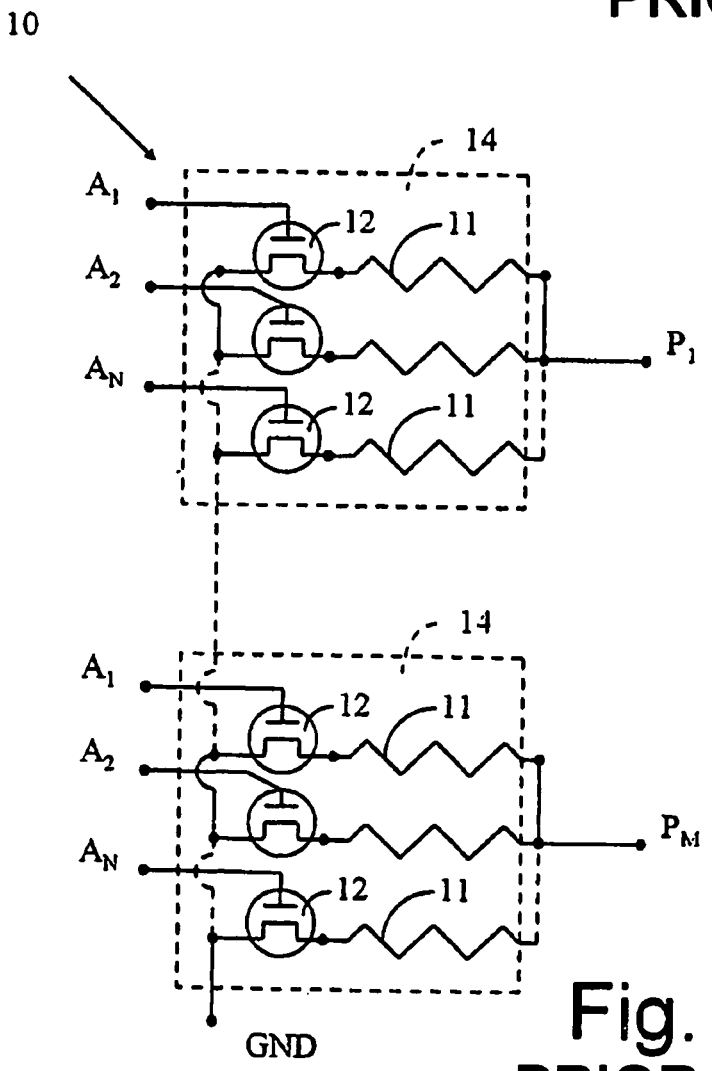
Fig. 2 PRIOR ART
FIG. 2 represents a wiring diagram of the circuit elements of an integrated printhead according to the known art.
Figure 3:
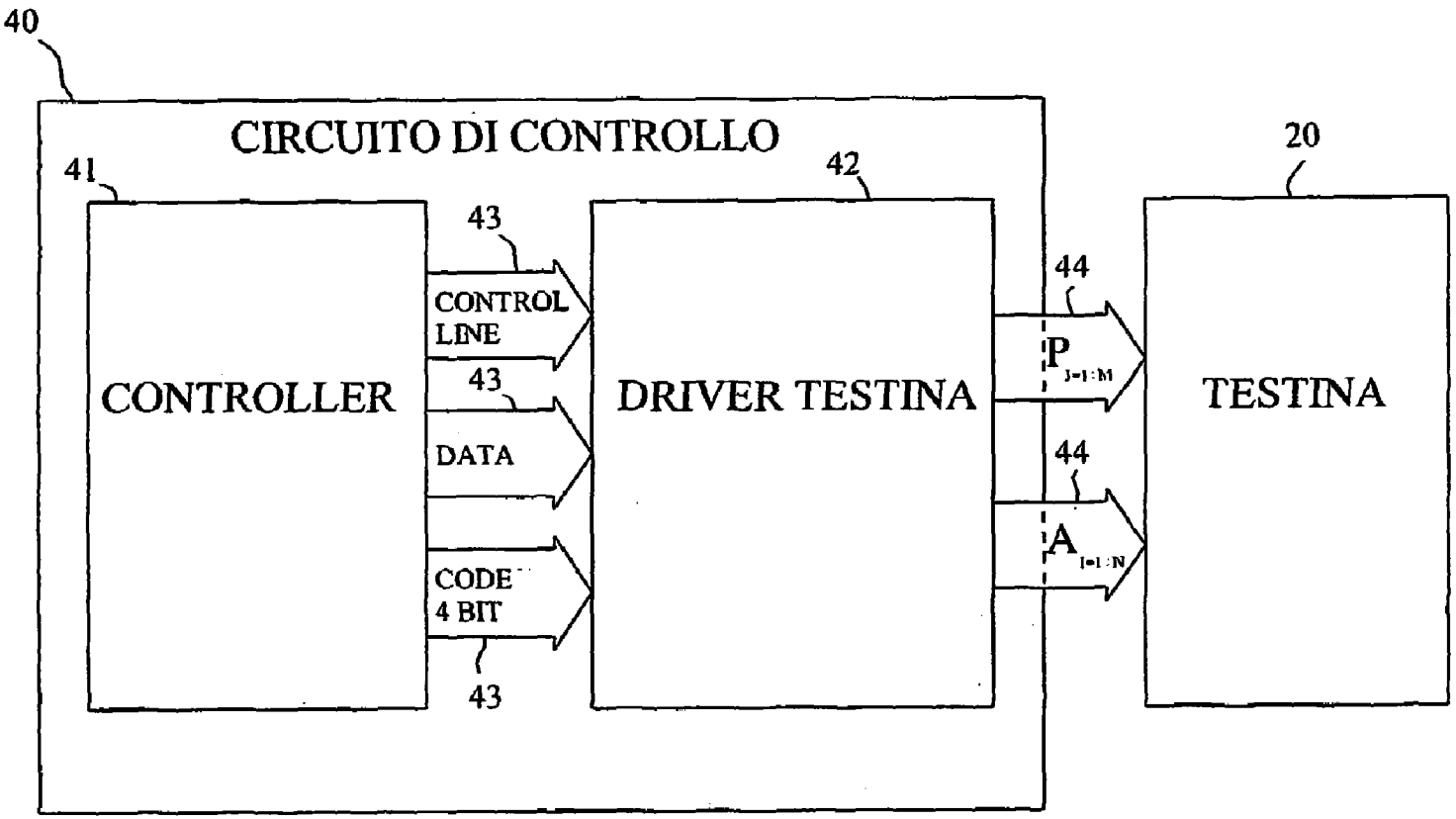
FIG. 3 represents a,block diagram of the control circuit of the head according to the invention.

As is known, the actuating elements 11; and selecting elements 12 are selected and commanded by a control circuit 40, external to the head, which comprises a "controller" 41, and a "head driver" 42, and is connected to the head by means of flexible circuits 44 (FIG. 3).

The controller 41 sends, through buses 43, the signals containing the print code (DATA), decoding of the 4-bit addresses $A_{I=1+N}$ (CODE) and the: timings (CONTROL LINE) of the nozzles to be selected, to the head driver 42, which in turn converts them into current pulses suitable for activating ejection of the ink from the corresponding nozzles.

The control circuit 40 is connected to the head by means of flexible circuits 44 and in particular by means of the contacts $P_{J=1+M}$ and $A_{I=1+N}$ (FIG. 3).

In the known heads, the control circuit 40 activates the ejection of ink by the nozzles of the head, according to the following order:

activates for a given time, a first address $A_I$;

electrically powers with predetermined current pulses and through the contacts $P_J$, a predefined configuration of primitives;

activates in sequence a second address;

electrically powers, with predetermined current pulses and through the contacts $P_J$, a second predefined configuration of primitives; and so on in successive steps until activation of the N addresses is complete.

Through logic signals and in a known way the control circuit 40 of the printer, therefore, is suitable for activating in sequence the addresses $A_{1-N}$ and, consequently, the N gates of the transistors 12 of the actuating assemblies 14 and of the encoding assemblies 24.

By means of the contacts $P_J$, the control circuit is suitable, in a known way, for electrically powering, upon variation of the addresses $A_I$, predefined configurations of primitives so as to activate the ejection of ink by the nozzles corresponding to the active address $A_I$ and to the configuration of primitives powered.

In the head according to the invention the encoding of the head is physically produced by activating, through the contacts $A_I$, the addresses corresponding to the fuses 21 that have to be burnt, and by powering the corresponding primitives with pulses having a voltage and a duration suitable for burning the fuses (for example, voltage of 10 V and pulses of 3÷4 μs).

In this way, codes can be stored on each head corresponding to data relating to characteristics of the head, such as for instance droplet diameter and speed, threshold energy.

The maximum pulse voltage +V applied to the contacts $P_J$ in the encoding step must be less than, with a safety margin, the breakdown voltage (drain/substrate) of all the selecting elements 12 (MOS) connected to $P_J$ to avoid damaging the head. For instance, in heads with droplets of a few pl, where the threshold energy is 1-2 μJ, the currents are less than 100 mA and the voltage applied in the encoding step is approx. 5-6 V, while the breakdown voltage of the transistors is approx. 15 V. In this way, there is a delta V of safety between the voltage needed to blow the fuses 21 and the breakdown voltage of the transistors 12.

According to a characteristic of this invention, to read the encoding, a known type of circuit called "nozzle check", which is part of the head driver 42, may be used without having to build a specific circuit or modify the driver, using the known control circuit 40, simply by modifying the head management software.

At the start of each printing step, before activating the ejection of ink, the control circuit 40 checks integrity of the resistors, by means of the function called "nozzles check" incorporated in the head driver 42.

During the nozzle check, the entire grid is scanned by sending to the primitives $P_J$ a current called "check current" to verify integrity of the resistors.

The check current is very low (10 mA) and is not sufficient to activate the ejection of ink by the nozzles, but simply verifies efficiency of the resistors.

At the same time, through the check current, the fuses 21 can be checked to see whether they are open or integral, and thus the encoding stored in the head is read.

Second Embodiment

The second embodiment refers to the case of heads that have the grid (M×N) full, i.e. That use all the M×N nozzles 31, activated by the corresponding resistors 11.

Figure 5:
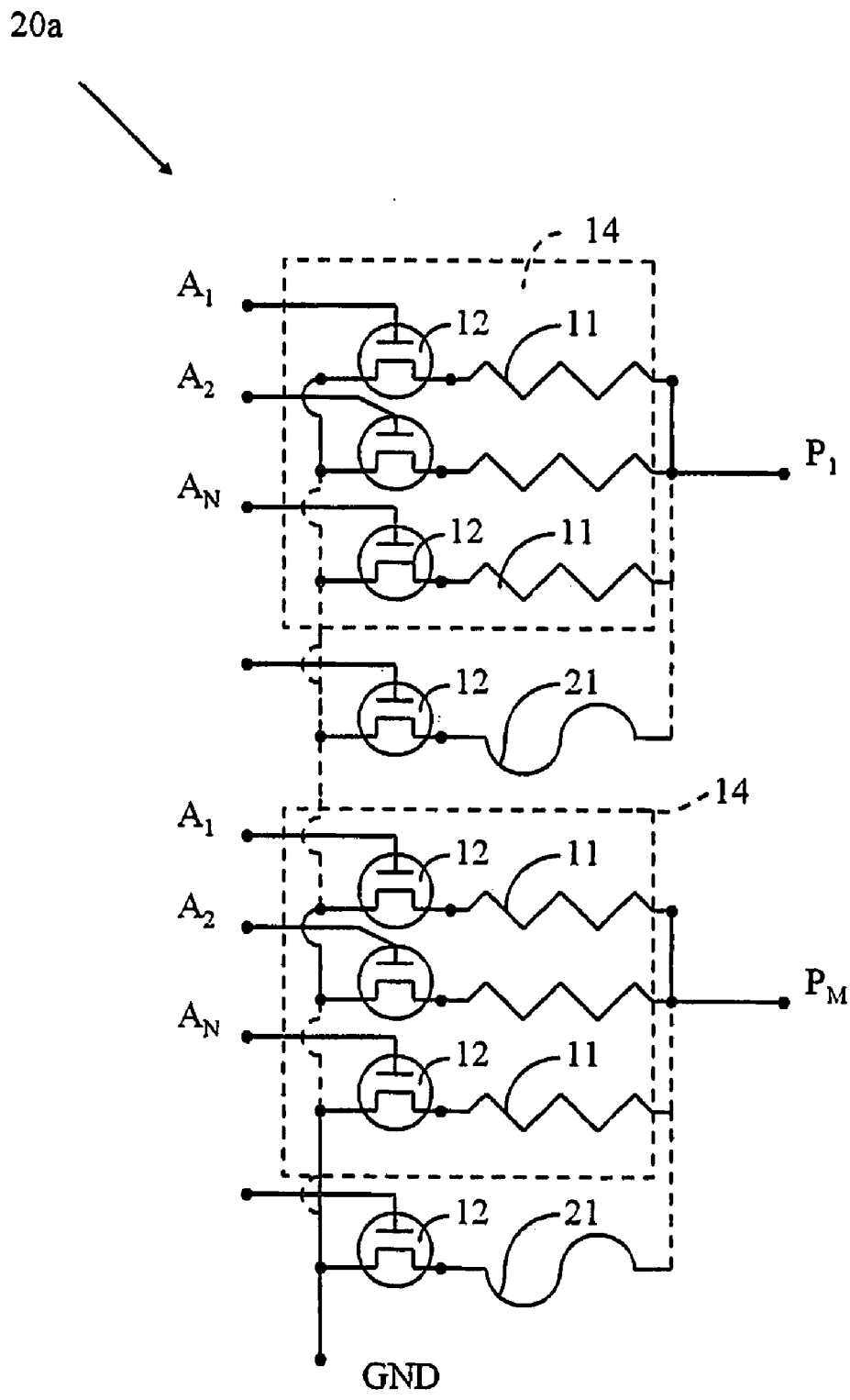
FIG. 5 represents a wiring diagram of the circuit elements of a second embodiment of an integrated head according to the invention.

A printhead according to the invention comprises a driving and encoding circuit 20*a*, a grid, made up of a plurality of actuating assemblies 14, of known type, to which are added one or more addresses $A_{I=N+K}$; a fuse 21 and a corresponding transistor 12 are also made, connected to each of the addresses $A_{I=N+K}$ added to the grid circuit (FIG. 5).

Take by way of example a head comprising 208 nozzles 31 and having 16 (M) primitives $P_{J=1-M}$ and 13 (N) addresses $A_{I=1+N}$ suitable for use.

There are therefore 208 (16*13=208) positions available for driving the nozzles, all occupied by the resistors 11, and no free position remains to be used for the encoding circuit, that could accommodate the fuses 21.

In this case, unable to make use of empty positions of the grid M×N to accommodate the encoding circuit, one or more addresses $A_{I=N+K}$ are added to the grid circuit, to which a fuse 21 and a corresponding transistor 12 are connected.

In the example cited, of a head with 16 (M) primitives $P_{J=1-M}$ and 13 (N) addresses $A_{I=1+N}$, for each address $A_{I=N+K}$ added, there are 16 (M) positions available for accommodating a fuse 21 and a transistor 12, and therefore 16 encoding bits available for each new address.

The encoding circuits (fuses 21 and transistors 12) cannot be included in the grid, and are therefore placed in the area available between the contacts 23.

Figure 6:
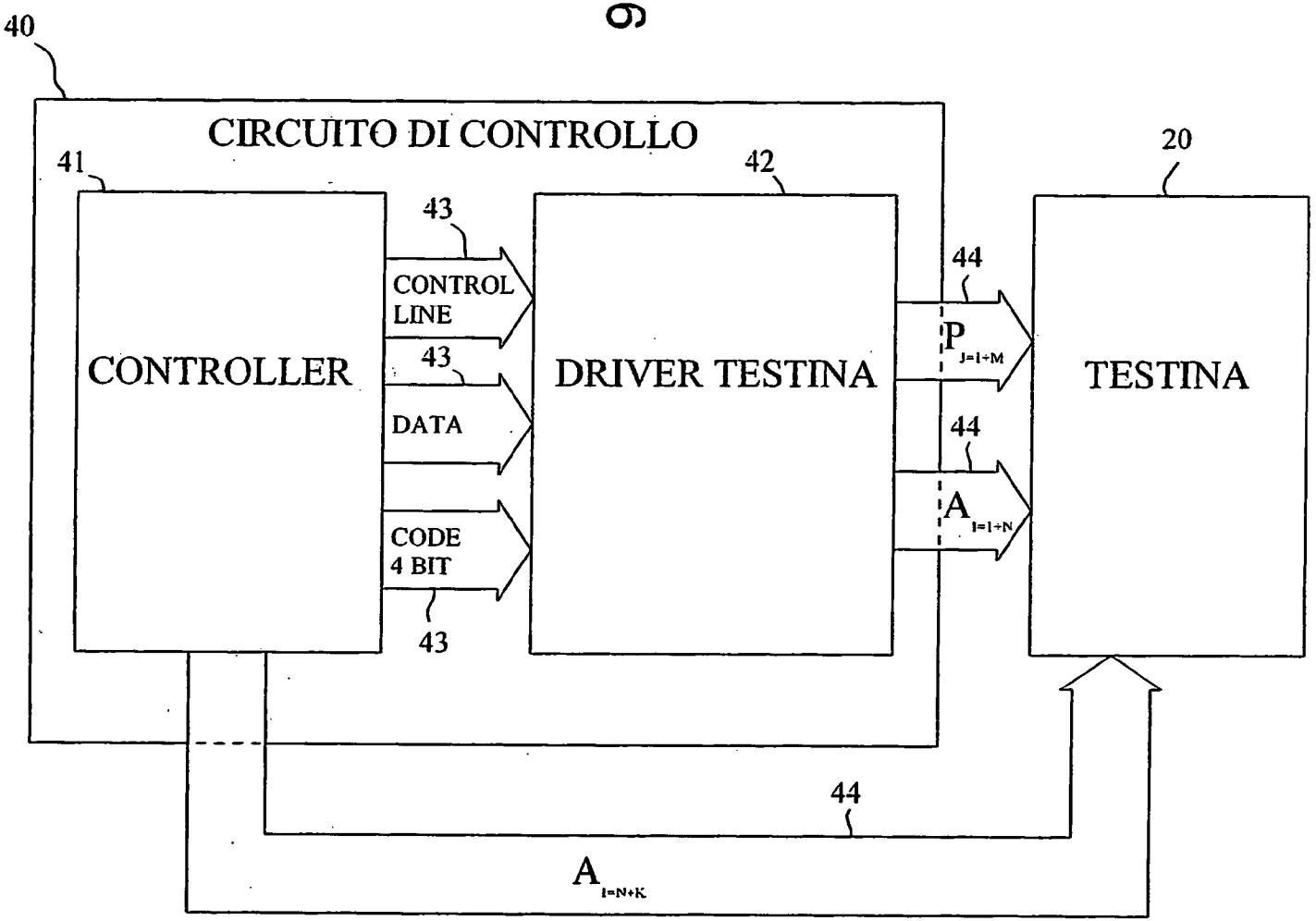
FIG. 6 represents a block diagram of a second embodiment of the control circuit of the head according to the invention.

In the second embodiment also, reading of the encoding takes place in the nozzle check phase; in this case, in the nozzle check the driver 42 scans all the N×M positions occupied by the resistors 11 activating the nozzles, and K connections 44 more are needed between the controller 41 and the addresses $A_{I=N+K}$ added for the encoding, as depicted in FIG. 6.

The K addresses added are therefore only activated in the step of reading the encoding and in that of physically producing the encoding, which takes place in the same way as described in the first embodiment.

The printhead, according to the invention, offers numerous advantages in comparison with the known art. In fact, the encoding circuit uses parts of the existing driving circuit and contacts, without changing them or with a limited increase in the surface area occupied by this circuit. Furthermore, for reading of the encoding of the head, the nozzle check step already present in operation of the head is used, without slowing down the printing preliminaries.

Naturally, without prejudice to the principle of the invention, the embodiments and construction details may be amply varied with respect to what has been described and illustrated purely by, way of non-restrictive example, without departing from the scope of this invention.

The invention claimed is:

1. An ink jet printhead comprising:

an integrated driving and encoding circuit having a grid-like structure and comprising:

a plurality of inputs and a plurality of selecting elements, a plurality of actuating elements electrically connected to the plurality of inputs, the plurality of actuating elements adapted to be selectively addressed and commanded by said selecting elements in response to at least one command signal received through said plurality of inputs, so as to cause the ejection of ink droplets from said ink jet printhead, and at least one identifying element of said ink jet printhead, wherein each of said identifying elements of said ink jet printhead is part of the grid-like structure of the driving and encoding circuit, and is in electrical communication with a corresponding selecting element of said driving and encoding circuit, the at least one identifying element adapted to be selectively addressed and identified in response to at least one corresponding identifying signal received through said plurality of inputs.

2. The ink jet printhead according to claim 1, wherein said plurality of actuating elements and each of said identifying elements are suitable for being sounded through at least one corresponding command signal received through said plurality of inputs, during a preliminary checking step, the purpose of which is to identify said ink jet printhead and to confirm the correct operation of said actuating elements.

3. The ink jet printhead according to claim 1, wherein said actuating elements are resistors and said ink jet printhead is of the thermal, bubble type for activating the ejection of said ink droplets.

4. The ink jet printhead according to claim 1, wherein said identifying elements are made of a plurality of resistors each resistor having a resistivity that has been selectively set during a manufacturing process of said ink jet printhead, depending on its characteristics.

5. The ink jet printhead according to claim 1, further comprising:

a substrate including a plurality of nozzles used for printing, and a plurality of nozzles not used for printing;

wherein the actuating elements occupy positions on the grid-like structure that are located in correspondence with the nozzles used for printing, and the identifying elements occupy positions on the grid-like structure that are located in correspondence with the nozzles not used for printing.

6. An ink jet printhead comprising:

an integrated driving and encoding circuit having a grid-like structure and comprising:

a plurality of inputs, a plurality of selecting elements, a plurality of actuating elements adapted to be selectively addressed and commanded by said selecting elements in response to at least one command signal received through said plurality of inputs, so as to cause the ejection of ink droplets from said ink jet printhead, and at least one identifying element of said ink jet printhead, wherein each of said identifying elements of said ink jet printhead is part of the grid-like structure of the driving and encoding circuit, and is in electrical communication with a corresponding selecting element of said driving and encoding circuit, the at least one identifying element adapted to be selectively addressed and identified in response to at least one corresponding identifying signal received through said plurality of inputs.

7. An integrated ink jet printhead comprising:

a plurality of actuating elements for causing ejection of ink droplets from said ink jet printhead, an integrated driving and encoding circuit having a grid-like structure, for selectively addressing and commanding each of said actuating elements, said grid-like structure being organized into rows and columns that define a plurality of nodes, with the plurality of actuating elements being located at the nodes one or more identifying elements of said ink jet printhead, wherein said one or more identifying elements of said ink jet printhead are located at the nodes arranged along a given row or column of said grid-like structure, and further wherein said one or more identifying elements are also adapted to be scanned, together with said actuating elements, during a preliminary checking step, the purposes of which are both to identify said ink jet printhead and to confirm correct operation of said actuating elements.

8. The ink jet printhead according to claim 6, further comprising:

a substrate including a plurality of nozzles used for printing, and a plurality of nozzles not used for printing;

wherein the actuating elements occupy positions on the grid-like structure that are located in correspondence with the nozzles used for printing, and the identifying elements occupy positions on the grid-like structure that are located in correspondence with the nozzles not used for printing.

9. The integrated ink jet printhead according to claim 7, further comprising:

a substrate including a plurality of nozzles used for printing, and a plurality of nozzles not used for printing;

wherein the actuating elements occupy nodes on the grid-like structure that are located in correspondence with the nozzles used for printing, and the identifying elements occupy nodes on the grid-like structure that are located in correspondence with the nozzles not used for printing.

* * * * *

UNITED STATES PATENT AND TRADEMARK OFFICE

CERTIFICATE OF CORRECTION

PATENT NO. : 7,367,655 B2
APPLICATION NO. : 10/538749
DATED : May 6, 2008
INVENTOR(S) : Alessandro Scardovi and Renato Conta It is certified that error appears in the above-identified patent and that said Letters Patent is hereby corrected as shown below:

Title Pg, Item (75) Inventors names should be corrected to read as follows:

(75) Inventors: Alessandro Scardovi
Renato Conta

Signed and Sealed this

Twelfth Day of August, 2008

JON W. DUDAS
*Director of the United States Patent and Trademark Office*